US008397411B2

(12) United States Patent
Russo et al.

(10) Patent No.: US 8,397,411 B2
(45) Date of Patent: Mar. 19, 2013

(54) MAGNET-BASED MOUNTING SYSTEMS FOR FRAMES

(76) Inventors: Kelley M. Russo, Dayton, OH (US); Samuel J. Russo, Dayton, OH (US)

( * ) Notice: Subject to any disclaimer, the term of this patent is extended or adjusted under 35 U.S.C. 154(b) by 11 days.

(21) Appl. No.: 12/917,130

(22) Filed: Nov. 1, 2010

(65) Prior Publication Data

US 2011/0042542 A1 Feb. 24, 2011

Related U.S. Application Data

(63) Continuation-in-part of application No. 12/009,801, filed on Jan. 22, 2008, now abandoned.

(51) Int. Cl.

| | |
|---|---|
| ***G09F 7/04*** | (2006.01) |
| ***A47G 1/06*** | (2006.01) |
| ***A47G 1/16*** | (2006.01) |
| ***A44C 3/00*** | (2006.01) |

(52) U.S. Cl. ..... 40/711; 40/621; 40/1.5; 40/745; 40/757; 40/209; 248/467; 434/127; 434/428

(58) Field of Classification Search ..... 40/621, 40/1.5, 711, 745, 757, 209; 248/467; 434/127, 434/428

See application file for complete search history.

(56) References Cited

U.S. PATENT DOCUMENTS

| | | | | |
|---|---|---|---|---|
| 2,742,250 | A | 4/1956 | Cronberger | |
| 3,239,178 | A * | 3/1966 | Pompa | 248/205.3 |
| 3,885,336 | A | 5/1975 | Olsen | |
| 3,942,147 | A | 3/1976 | Josephson | |
| 4,211,382 | A | 7/1980 | Bonfils | |
| 4,309,016 | A * | 1/1982 | Tendler | 248/467 |
| 4,413,421 | A | 11/1983 | Siniuk | |
| 4,704,337 | A | 11/1987 | Coppens et al. | |
| 4,817,320 | A | 4/1989 | Fraynd | |
| 5,269,083 | A * | 12/1993 | Vampatella et al. | 40/711 |
| 5,596,829 | A | 1/1997 | Komamura | |
| 6,318,698 | B1 | 11/2001 | Hansen | |
| 6,322,039 | B1 * | 11/2001 | De Luccia | 248/553 |
| 6,889,457 | B2 | 5/2005 | Boddie | |
| 6,889,458 | B2 * | 5/2005 | Copley | 40/711 |
| 2007/0039221 | A1 * | 2/2007 | Huang | 40/757 |
| 2007/0044360 | A1 | 3/2007 | Hillis | |

* cited by examiner

*Primary Examiner* — James Kramer
*Assistant Examiner* — Syed A Islam
(74) *Attorney, Agent, or Firm* — Thomas E. Lees, LLC

(57) ABSTRACT

A magnet-based frame mounting system comprises a frame plate that is magnetically attractive and a wall plate that is magnetically attractive. The frame plate has a first surface that mechanically mounts within a rear surface of a frame. Correspondingly, the wall plate has a first surface that mechanically mounts directly to a wall. When the frame plate is mounted to a corresponding frame, the wall plate is mounted to a corresponding wall, and the frame plate is magnetically coupled to the frame plate, the frame plate is concealed by the frame, the wall plate is concealed by the frame and the frame is repositionable in any direction parallel to the wall plate, without repositioning the wall plate, such that the frame stays at a set location based upon the magnetic coupling between the frame plate and the wall plate.

18 Claims, 9 Drawing Sheets

MAGNET-BASED MOUNTING SYSTEMS FOR FRAMES

CROSS-REFERENCE TO RELATED APPLICATIONS

This application is a continuation-in-part of U.S. application Ser. No. 12/009,801, filed Jan. 22, 2008, entitled MAGNET-BASED MOUNTING SYSTEM FOR FRAMES, the entirety of which is incorporated herein by reference.

BACKGROUND

The present invention relates to mounting mechanisms for wall hangings and, more particularly, to systems and methods for mounting and repositioning wall hangings such as picture frames.

It is common practice for people to hang items such as pictures, paintings and other functional and/or decorative items on walls. In this regard, reliance has been placed upon hanging devices that utilize conventional approaches such as wire and nails, saw tooth or ring hangers, picture hooks, screws and wall anchors, fastening tape, glue, adhesive, etc., to mount the wall hanging to a wall. However, regardless of the conventional hanging device utilized, wall hangings, especially framed pictures, tend to tilt relative to their desired position when hung on a wall. For instance, picture frames tilt for a variety of reasons, such as excessive play in the hanging device or use of large gauge hanging wire that is too stiff to allow a proper (inverse) catenary hanging stance. Tilt may also occur where a nail or screw that suspends the picture frame does not balance the frame relative to the center of gravity of the frame and the contents contained within the frame. Still further, in certain situations, a conventional hanging device can be detrimental to the structure of the frame itself, e.g., where the weight of the frame causes the frame members to deform or where the weight of the frame causes the coupling means between the frame and the conventional picture hanger to fail.

BRIEF SUMMARY

According to aspects of the present invention, a magnet-based frame mounting system comprises a frame plate, which is magnetically attractive, and a wall plate, which is also magnetically attractive. The frame plate has a first surface that mounts within a rear surface of a frame. Correspondingly, the wall plate has a first surface that mounts directly to a wall. When the frame plate is mounted to a corresponding frame, the wall plate is mounted to a corresponding wall, and the frame plate is positioned over the wall plate, the wall plate magnetically couples to the frame plate such that the frame plate is concealed by the frame and the wall plate is concealed by the frame. Moreover, the frame is repositionable in any direction parallel to the wall plate, without repositioning the wall plate, such that the frame stays at a set location based upon the magnetic coupling between the frame plate and the wall plate.

According to further aspects of the present invention, a method for mounting a frame on a wall comprises mounting a magnetically attractive frame plate within a rear surface of a frame, and mounting a magnetically attractive wall plate directly to a wall. The method further comprises magnetically coupling the frame plate to the wall plate such that the frame conceals the frame plate and the frame conceals the wall plate. The method further comprises repositioning the frame in any direction parallel to the wall plate to achieve a desired location on the wall without moving the wall plate such that the frame stays at the desired location based upon the magnetic coupling between the frame plate and the wall plate.

According to still further aspects of the present invention, a method of hanging multiple frames on a wall comprises mounting a first magnetically attractive frame plate within a rear surface of a first frame and mounting a first magnetically attractive wall plate directly to a wall. The method further comprises magnetically coupling the first frame plate to the first wall plate and repositioning the first frame in any direction parallel to the first wall plate to achieve a set location of the first frame on the wall without moving the first wall plate such that the first frame stays at the desired location based upon the magnetic coupling between the first frame plate and the first wall plate. The method still further comprises mounting a second magnetically attractive frame plate within a rear surface of a second frame and mounting a second magnetically attractive wall plate directly to the wall, where the second wall plate is distinct and spaced from the first wall plate.

The method still further comprises magnetically coupling the second frame plate to the second wall plate and repositioning the second frame in any direction parallel to the second wall plate without moving the second wall plate to achieve a set location of the second frame that forms a desired pattern in coordination with the set location of the first frame such that the second frame stays at the desired location based upon the magnetic coupling between the second frame plate and the second wall plate.

BRIEF DESCRIPTION OF THE SEVERAL VIEWS OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DETAILED DESCRIPTION

Figure 1:
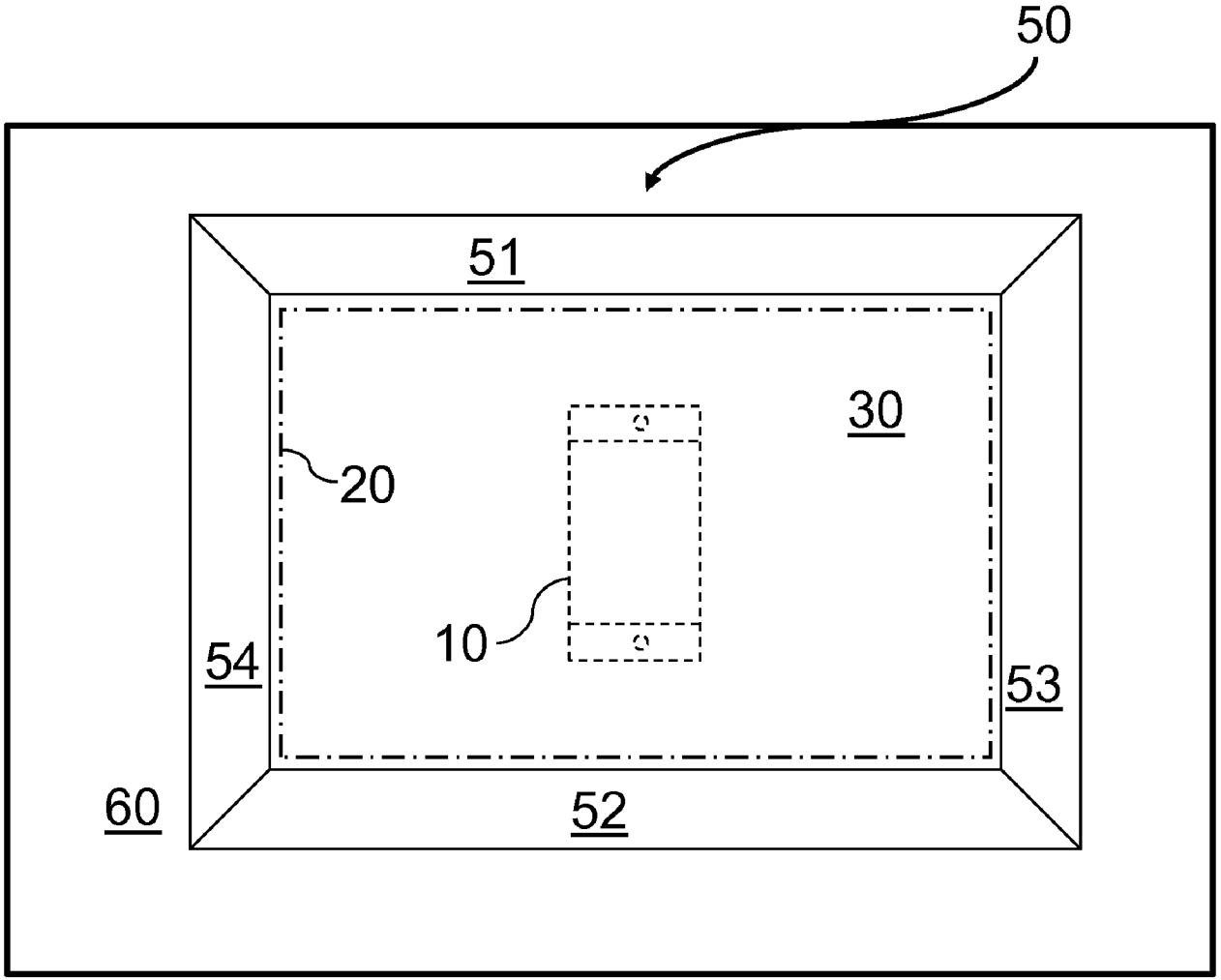
FIG. 1 is a front view of a picture frame hung on a wall using a magnet-based mounting system, according to aspects of the present invention.

Various aspects of the present invention provide a magnet-based frame mounting system, which can be used on a variety of surfaces, including walls within a home or business. The magnet-based frame mounting system provides mounting plates, including a frame plate and a wall plate, which are capable of magnetic adhesion suitable for setting, resetting or otherwise adjusting the placement and/or orientation of an object, such as a picture frame or other wall hanging, on a wall or other substantially planar surface that can support the weight of the object.

According to various aspects of the present invention, a magnet-based frame mounting system is provided to affix a frame, such as a picture frame, securely to a mounting surface, e.g., wall. Once mounted, the frame may be rotated, pivoted or otherwise re-oriented in a plane parallel to the mounting surface such that the frame maintains placement at any set angle. Various allowances are also provided for movement of the frame. Thus, precise horizontal and vertical placement of the frame can be easily achieved. For example, the frame can be easily repositioned on the wall within a limited range of distance determined by the magnetic coupling capabilities of the magnet-based frame mounting system, as will be described in greater detail herein.

Moreover, the magnet-based frame mounting system that is described more fully herein, eliminates unintended skew or other undesirable deviation of the frame position over time, relative to a user-set placement and orientation of the frame. The magnet-based frame mounting system further eliminates or otherwise significantly reduces the likelihood of incidences where the frame might otherwise be bumped off the wall. Still further, the magnet-based frame mounting system can be used to mount frames substantially flat against a wall, thus preventing the keystone effect and/or other visual aberrations that may otherwise occur when observers look upon artwork portrayed within a mounted frame, due to angling of the top of the frame away from the wall, e.g., as often occurs with conventional picture hangers.

According to additional aspects of the present invention, the ability to reposition and/or rotate a frame mounted on a wall using a magnet-based frame mounting system described herein, further enables precise horizontal and vertical placement for a group of frames (each mounted using an independent instance of the magnet-based frame mounting system), where the frames may be positioned in a single row/column, in multiple rows/columns or in another desired pattern. Still further aspects of the present invention provide a magnet-based frame mounting system that provides a means to facilitate overall frame placement and/or achieves a parallel wall to frame installation, minimizing viewing distortion and, in the case of multiple frames, achieves a uniform group appearance.

In this regard, the magnet-based frame mounting systems described herein, further allow for the unorthodox placement of frames and the like, in many orientations different from those of conventional orientation, e.g., the side edges of a rectangular frame do not need to be plumb to the vertical of the wall, regardless of the center of gravity of the frame and its contents, thus providing mounting options that are impossible or very difficult with conventional picture hangers.

Referring now to the drawings, and in particular to FIG. 1, a magnet-based frame mounting system comprises in general, two plates, including a wall plate 10 and a frame plate 20 that can be magnetically coupled together. Magnetic coupling between the wall plate 10 and the frame plate 20 may be implemented using a permanent magnet such as, but not limited to, a circular magnet, a block magnet, or sheet magnet. In this regard, both the wall plate 10 and the frame plate 20 include magnetically attractive material.

The frame plate 20 magnetically couples to the wall plate 10 to support an object, such as artwork 30 that is arranged in a picture frame 50, as will be described in greater detail herein.

For purposes of this application, the term "artwork" is intended to include, but is not limited to, items such as: pictures, photographs, drawings, paintings, lithographs, printed images, and other art pieces, mirrors, blackboards, whiteboards, clocks, flat panel displays, digital picture frames, and other types of functional and/or decorative wall hangings.

For purposes of this application, the term "frame" is intended to include, but is not limited to, a structure that bounds the artwork 30 in border that is often decorative. A frame 50 is typically made of wood, metal, plastic or combinations thereof, and can be utilized as a support structure for holding the artwork 30, and/or as a support structure for mounting the artwork 30 to a wall. Moreover, the frame 50 is typically separate from artwork 30 to be mounted within the frame 50. For instance, the illustrated frame 50 holds the associated piece of artwork 30 and includes frame moldings 51, 52, 53, 54 that form a decorative border to provide an aesthetic presentation of the artwork 30.

The wall plate 10 is magnetically attractive and has a first surface that mounts directly to a planar surface such as a wall 60. Correspondingly, the frame plate 20 is magnetically attractive and includes a first surface that mounts within a rear surface of the frame 50. When the frame plate 20 is mounted to the frame 50 as illustrated, and when the wall plate 10 is mounted to a corresponding wall 60, also as illustrated, the frame 50 can be mounted to the wall 60 through magnetic coupling of the wall plate 10 to the frame plate 20. The frame 50 can likewise be easily removed by pulling or otherwise lifting the frame 50 from the wall 60 so as to break the magnetic attraction between the wall plate 10 and the frame plate 20.

Thus, when the frame plate 20 is positioned over the wall plate 10, the wall plate 10 magnetically couples to the frame plate 20. Moreover, as illustrated, the frame plate 20 is concealed by the frame 50. Similarly, the wall plate 10 is concealed by the frame 50. This conveys the impression that the frame 50 and its contents are mounted directly on the surface of the wall 60. Also, as noted in greater detail herein, the frame 50 is repositionable in any direction parallel to the wall plate 10, without repositioning the wall plate 10.

Moreover, the frame 50 stays at a set location based upon the magnetic coupling between the wall plate 10 and the frame plate 20. As such, the problem typically encountered with a "crooked picture" is avoided. In this regard, the extent to which the frame 50 is repositionable is limited only to the ability of the wall plate 10 and frame plate 20 to maintain magnetic coupling when the frame 50 is mounted to the wall 60. For instance, as illustrated in FIG. 1, the frame plate 20 is dimensionally larger than the wall plate 10 to allow for a range of adjustments to the frame orientation and/or frame position on the wall 60, while maintaining magnetic coupling of the wall plate 10 to the frame plate 20, e.g., some degree of overlap between the wall plate 10 and the frame plate 20.

Figure 2:
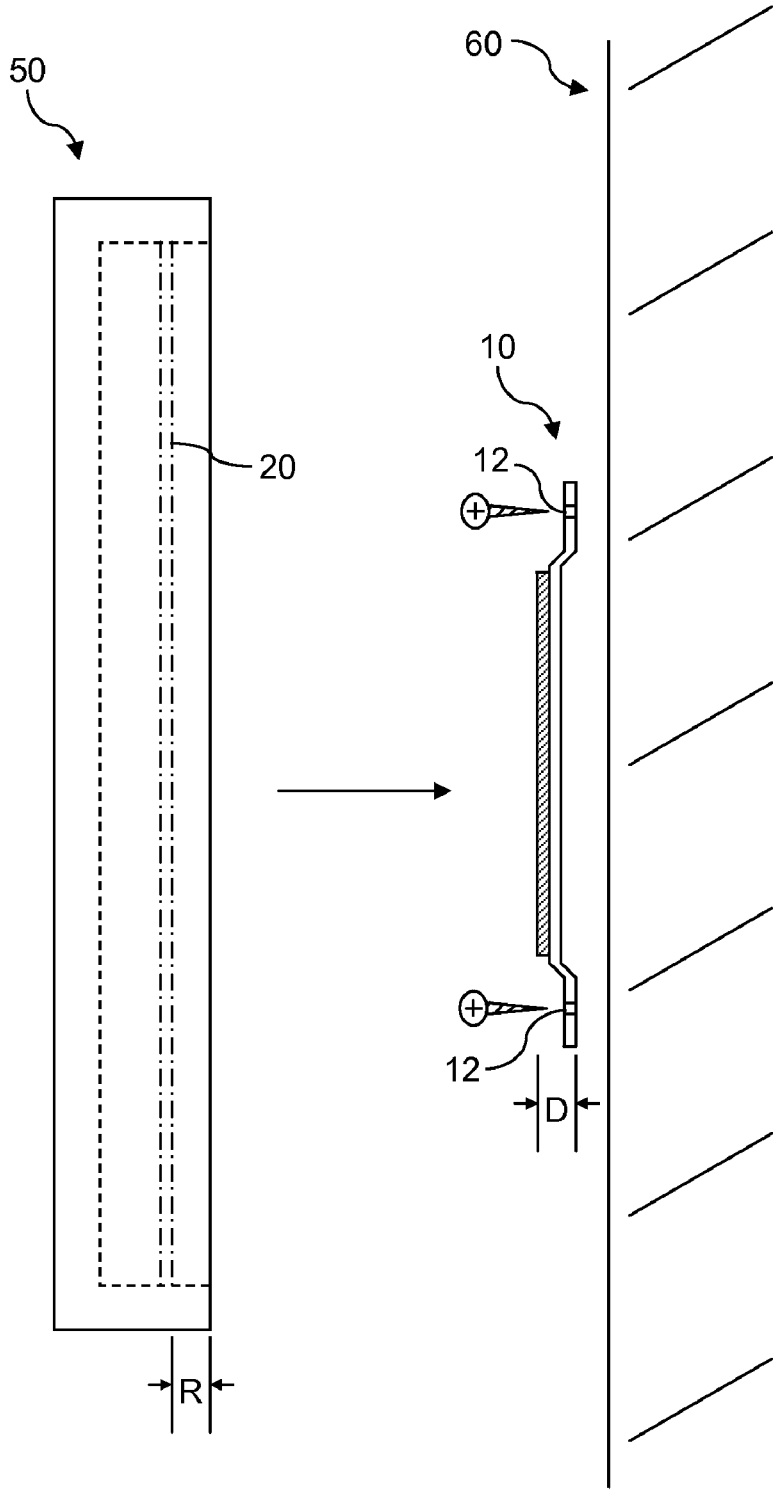
FIG. 2 is a side schematic break-away view of select components of a magnet-based mounting system utilized to mount a frame to a wall, according to aspects of the present invention.

Referring to FIG. 2, the wall plate 10 includes mounting holes 12, which allow the wall plate 10 to be mounted directly to an associated wall 60. For instance, the illustrated wall plate 10 is secured to the wall 60 using two screws. However, the wall plate 10 may alternatively be mounted to the wall using other mounting approaches, including for example, mechanical and/or chemical means, such as nails, adhesive, etc. In this regard, the wall plate 10 is not required to be permanently attached to the associated wall 60. For example, the wall plate 10 can be removed from first position on a wall by unscrewing the two screws and lifting the wall plate 10 from the wall 60. Thus, when the wall plate 10 is removed, the only marks on the associated wall 60 are likely no more obtrusive than marks that would have been left by a conventional picture hanger. Moreover, the wall plate 10 can be easily re-located to a different location, e.g., on the same wall or a different wall.

As illustrated, the wall plate 10 is not flat. Rather, the wall plate 10 is implemented as a strip that includes a flange or bend at each of the top and bottom ends thereof. As a result, there is a slight gap between the wall and a major planar surface of the wall plate 10. For instance, as illustrated, the major planar surface of the wall plate 10 extends from the wall 60 by a measurement, denoted as 'D'.

As noted above, the frame plate 20 mounts within a rear surface of the frame 50. The frame plate 20 may be mounted to the associated frame 50 by any means such as, but not limited to, screws, adhesive, nails, hooks, staples, etc. Due to the configuration of most picture frames, the frame plate 20 is likely to be slightly recessed relative to the back edge of the frame 50. For instance, the frame plate 20 may be about the size of the corresponding cardboard back on the back of the frame 50 behind the artwork 30. The measurement of the recess of the frame plate 20 relative to the back edge of the frame 50 is denoted by an amount 'R', as illustrated. As such, when the frame 50 is mounted on the wall 60, the major surface of the wall plate 10 protrudes a sufficient amount into the recess of the back of the frame 50 to ensure a strong magnetic coupling with the frame plate 20.

For example, where the depth R of the recess equals the protrusion D of the major surface of the wall plate 10, the frame 50 sits substantially flush with the wall 60. In the event that the recess R is less than the protrusion D, the frame 50 is positioned substantially parallel to the wall plate 10, and the frame 50 is spaced slightly from the wall 60 by an amount corresponding to (D-R). In the event that the recess R is greater than the protrusion D, the slight gap between the major surface of the wall plate 10 and the wall 60 provides a slight amount of "play" that will allow the major surface of the wall plate 10 to deform, e.g., to flex outward from the wall slightly, in response to the magnetic coupling between the wall plate 10 and the frame plate 20 so as to ensure a proper magnetic coupling between the wall plate 10 and the frame plate 20.

As illustrated, the wall plate 10 includes a permanent magnet, e.g., a layer of permanently charged magnetic material, and the frame plate 20 includes a magnetically attractive portion, e.g., steel, but not a permanent magnet. Other exemplary configurations of the wall plate 10 and the frame plate 20 are set out in greater detail herein.

As an alternative to the illustrated configuration, the wall plate 10 may be substantially flat. In this exemplary implementation, the mounting holes 12 of the wall plate 10 may be recessed so the mounting method (e.g., screws, nails, hooks, etc.) does not reduce the surface area of a coupling area between the wall plate 10 and the frame plate 20.

Figure 3:
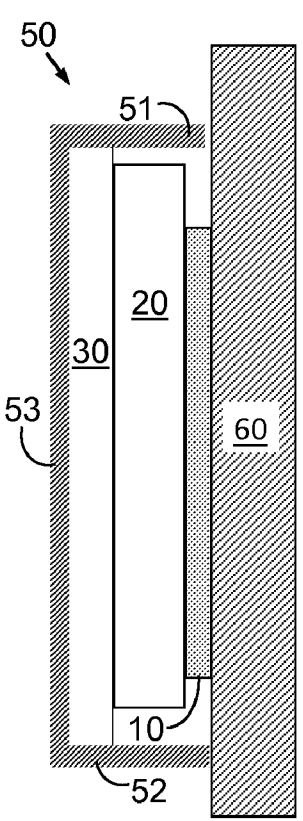
FIG. 3 is a side schematic view of a first configuration for a magnet-based mounting system according to aspects of the present invention.

Referring to FIG. 3, a schematic side view of an embodiment of the magnet-based mounting system is illustrated. The wall plate 10 is mounted directly to the associated wall 60. Correspondingly, the frame plate 20 is mounted to an associated frame 50. As described in greater detail herein, the frame members 51, 52, 53 shown in this view, bound and support the artwork 30. Moreover, due to the thickness of the frame members, the frame plate 20 sits in a recess on the back surface of the frame 50. In this illustrative exemplary view, the depth of the recess in the back of the frame 50 is less than the protrusion of the wall plate 10 from the wall. As such, the frame 50 sits slightly spaced from the wall 60.

Moreover, in this illustrative exemplary configuration, the wall plate 10 includes a magnetically attractive material, but not a permanent magnet. The frame plate 20 comprises a permanent magnet. Thus, when the frame plate 20 is placed over the wall plate 10, the two plates 10, 20 are magnetically coupled and the associated frame 50 is mounted on the associated wall 60. Moreover, the frame 50 conceals both the wall plate 10 and the frame plate 20.

Figure 4:
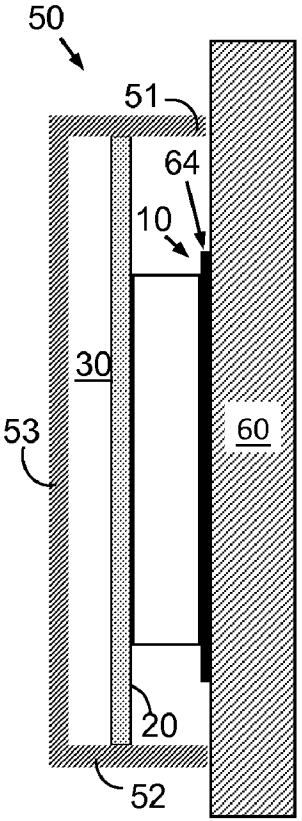
FIG. 4 is a side schematic view of an alternative configuration for a magnet-based mounting system according to aspects of the present invention.

Referring to FIG. 4, a schematic side view of another embodiment of the magnet-based mounting system is illustrated. In a manner analogous to that of FIG. 3, the wall plate 10 is mounted directly to the associated wall 60. Correspondingly, the frame plate 20 is mounted to an associated frame 50. The frame members 51, 52, 53 shown in this view, bound and support the artwork 30. Moreover, due to the thickness of the frame members, the frame plate 20 sits in a recess on the back surface of the frame 50. For purposes of clarity of discussion, in this illustrative exemplary view, the frame 50 sits slightly spaced from the wall 60.

However, in a manner opposite of FIG. 3, in this illustrative exemplary configuration, the wall plate 10 comprises a permanent magnet. The frame plate 20 includes a magnetically attractive material, but not a permanent magnet. Regardless, when the frame plate 20 is placed over the wall plate 10, the two plates 10, 20 are magnetically coupled and the associated frame 50 is mounted on the associated wall 60. Again, the frame 50 conceals both the wall plate 10 and the frame plate 20.

In the illustrative example, the wall plate 10 includes an optional backer 64. The backer 64 can be made of magnetically attractive material or non-magnetically attractive material. For instance, the backer 64 may provide a wide mounting surface that distributes weight across a large area of the wall, e.g., relative to the implementation of the wall plate 10 as illustrated in FIG. 2. The backer 64 may further serve as a shim, spacer or other leveling and/or positioning device to aid in the alignment of the frame 50 with the wall 60, and/or to aid in the proper engagement of the major surface of the wall plate 10 with the frame plate 20. As such, in this illustrative example, the wall plate 10 may comprise three or more layers assembled together, e.g., a magnetic layer may be adhered or otherwise attached to a major surface of a middle layer, e.g., a magnetically attractive layer that may have the structure of the wall plate of FIG. 2. Further, a backer 64 may be attached to the flanges of the middle layer. Alternatively, the middle layer could be substantially flat.

Figure 5:
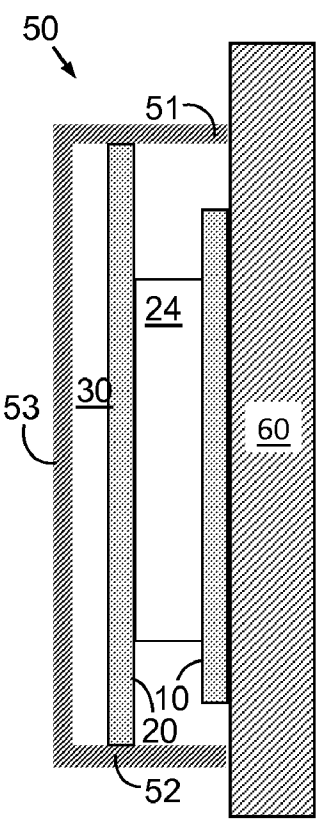
FIG. 5 is a side schematic view of still another alternative configuration for a magnet-based mounting system according to aspects of the present invention.

Referring to FIG. 5, a schematic side view of yet another embodiment of the magnet-based mounting system is illustrated. Again, in a manner analogous to that of FIG. 3, the wall plate 10 is mounted directly to the associated wall 60. Correspondingly, the frame plate 20 is mounted to an associated frame 50. The frame members 51, 52, 53 shown in this view, bound and support the artwork 30. Moreover, due to the thickness of the frame members, the frame plate 20 sits in a recess on the back surface of the frame 50. For purposes of clarity of discussion, in this illustrative exemplary view, the frame 50 sits slightly spaced from the wall 60.

In this illustrative exemplary embodiment, the wall plate 10 includes a magnetically attractive material, but not a permanent magnet. The frame plate 20 also includes a magnetically attractive material, but not a permanent magnet. However, this embodiment further includes an intermediate plate 24, which is a permanent magnet. Thus, frame plate 20 is placed over the wall plate 10 such that the intermediate plate 24 is placed between the frame plate 20 and the wall plate 10. In this regard, the three plates 10, 20, 24 are magnetically coupled, thus mounting the associated frame 50 on the associated wall 60.

An aspect of this embodiment is that the magnetic flux created by the intermediate plate 24 may be shielded from the artwork 30 (FIG. 1) by the frame plate 20, so the artwork 30 may comprise digital artwork, e.g., a digital picture, without fearing that the magnet (i.e., intermediate plate 24) will interfere with the electronics within the digital artwork 30. Another aspect of this embodiment is that a lower flux permanent magnet may be used as the intermediate plate 24, which allows for easier movement when the user repositions the associated frame 50. Yet another aspect of this embodiment is that the magnetic interaction between the frame plate 20, intermediate plate 24, and wall plate 10 reduce the rate of demagnetization over time. In this regard, the plates 10, 20, 24 may be maintained as three separate plates, or the intermediate plate 24 may be attached, e.g., permanently adhered, to a select one of the wall plate 10 or the frame plate 20.

Figure 6:
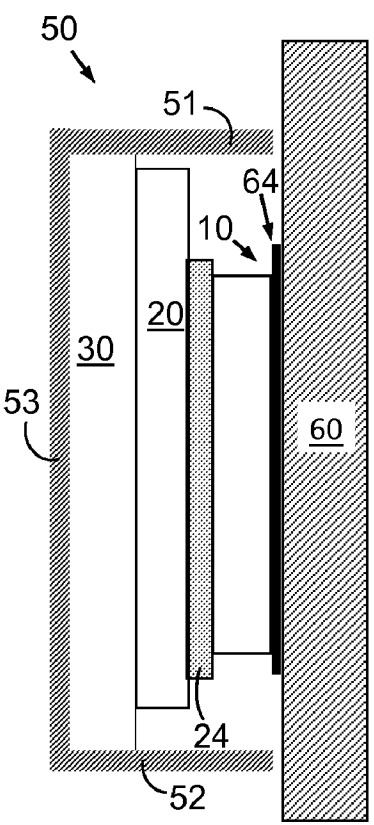
FIG. 6 is a side schematic view of yet another alternative configuration for a magnet-based mounting system according to aspects of the present invention.

Referring to FIG. 6, a schematic side view of still yet another embodiment of the magnet-based mounting system is illustrated. Again, in a manner analogous to that of FIG. 3, the wall plate 10 is mounted directly to the associated wall 60. Correspondingly, the frame plate 20 is mounted to an associated frame 50. The frame members 51, 52, 53 shown in this view, bound and support the artwork 30. Moreover, due to the thickness of the frame members, the frame plate 20 sits in a recess on the back surface of the frame 50. For purposes of clarity of discussion, in this illustrative exemplary view, the frame 50 sits slightly spaced from the wall 60.

In this illustrative exemplary embodiment, the wall plate 10, as shown, includes the backer 64. However, the wall plate 10 is not required to include the backer 64, as described more fully herein. Moreover, the wall plate 10 includes a permanent magnet. The frame plate 20 also includes a permanent magnet. However, this embodiment further includes an intermediate plate 24, which is a magnetically attractive material, but not a permanent magnet. Thus, frame plate 20 is placed over the wall plate 10 such that the intermediate plate 24 is placed between the frame plate 20 and the wall plate 10. In this regard, the three plates 10, 20, 24 are magnetically coupled, thus mounting the associated frame 50 on the associated wall 60. Also, the plates 10, 20, 24 may be maintained as three separate plates, or the intermediate plate 24 may be attached, e.g., permanently adhered, to a select one of the wall plate 10 or the frame plate 20.

Figure 7:
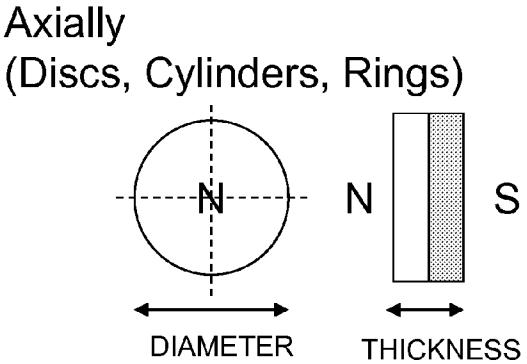
FIG. 7 is a schematic illustration of a circular magnet and vertical polarization thereof, which can be utilized as a magnetic member of a magnet-based mounting system according to aspects of the present invention.

As noted in greater detail herein, the magnet-based frame mounting system utilizes magnetic attraction to mount a frame to a wall. FIG. 7 is a schematic view of a circular magnet and vertical polarization thereof. As shown, the north and south poles of the circular magnet are disposed opposite one another on the left and right surface thereof.

Figure 8:
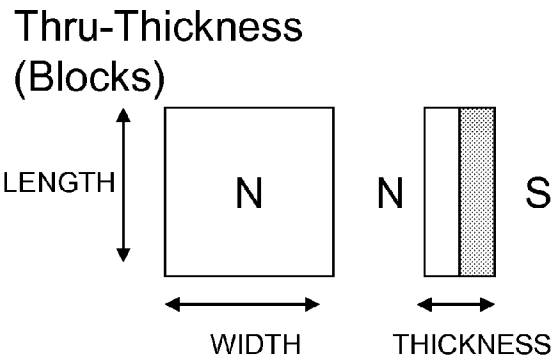
FIG. 8 is a schematic illustration of a block magnet and vertical polarization thereof, which can be utilized as a magnetic member of a magnet-based mounting system according to aspects of the present invention.

FIG. 8 is a schematic view of a block magnet and vertical polarization thereof. Once again, as shown, the north and south poles of the block magnet are disposed opposite one another on the left and right surface thereof.

Figure 9:
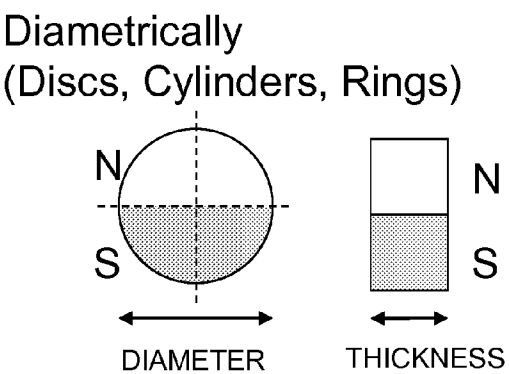
FIG. 9 is a schematic illustration of a circular magnet and horizontal polarization thereof, which can be utilized as a magnetic member of a magnet-based mounting system according to aspects of the present invention.

FIG. 9 is a schematic view of a circular magnet and horizontal polarization thereof. The north and south poles of the circular magnet are disposed opposite one another on the upper and lower surface thereof.

Figure 10:
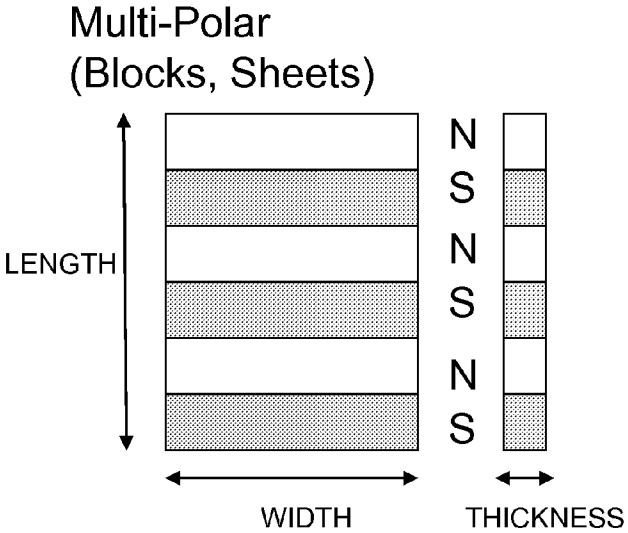
FIG. 10 is a schematic illustration of a block or sheet of magnetic material, each magnet being interleaved and alternately polarized, which can be utilized as a magnetic member of a magnet-based mounting system according to aspects of the present invention.

FIG. 10 is a schematic view of a block or sheet of magnetic material, each magnet being interleaved and alternately polarized.

Depending upon the specific implementation, magnets such as those illustrated in FIGS. 7-10 may be utilized, or other magnet types may be utilized, depending upon the specific implementation.

Picture alignment may be critical, especially when two or more pictures are placed in close proximity to each other, to preserve a desired aesthetic of the arrangement of the pictures. However, normal and abnormal vibrations that occur over time can dislodge originally precise picture orientation upsetting the desired aesthetic. Still further, it can be difficult using conventional hanging devices to properly space and orient multiple wall hangings to achieve a desired overall appearance.

However, FIGS. 11-14 show four independent magnet-based frame mounting systems, each frame mounting system used to mount a corresponding frame to a wall, according to aspects of the present invention. Particularly, a first magnet-based frame mounting system includes a first wall plate 10A and a first frame plate 20A, which cooperate to mount a first frame 50A to a wall 60. A second magnet-based frame mounting system includes a second wall plate 10B and a second frame plate 20B, which cooperate to mount a second frame 50B to the wall 60. A third magnet-based frame mounting system includes a third wall plate 10C and a third frame plate 20C, which cooperate to mount a third frame 50C to the wall 60. Finally, a fourth magnet-based frame mounting system includes a fourth wall plate 10D and a fourth frame plate 20D, which cooperate to mount a fourth frame 50D to the wall 60. In this regard, the wall plates 10A, 10B, 10C and 10D are arranged as corners of an imaginary rectangle.

Figure 11:
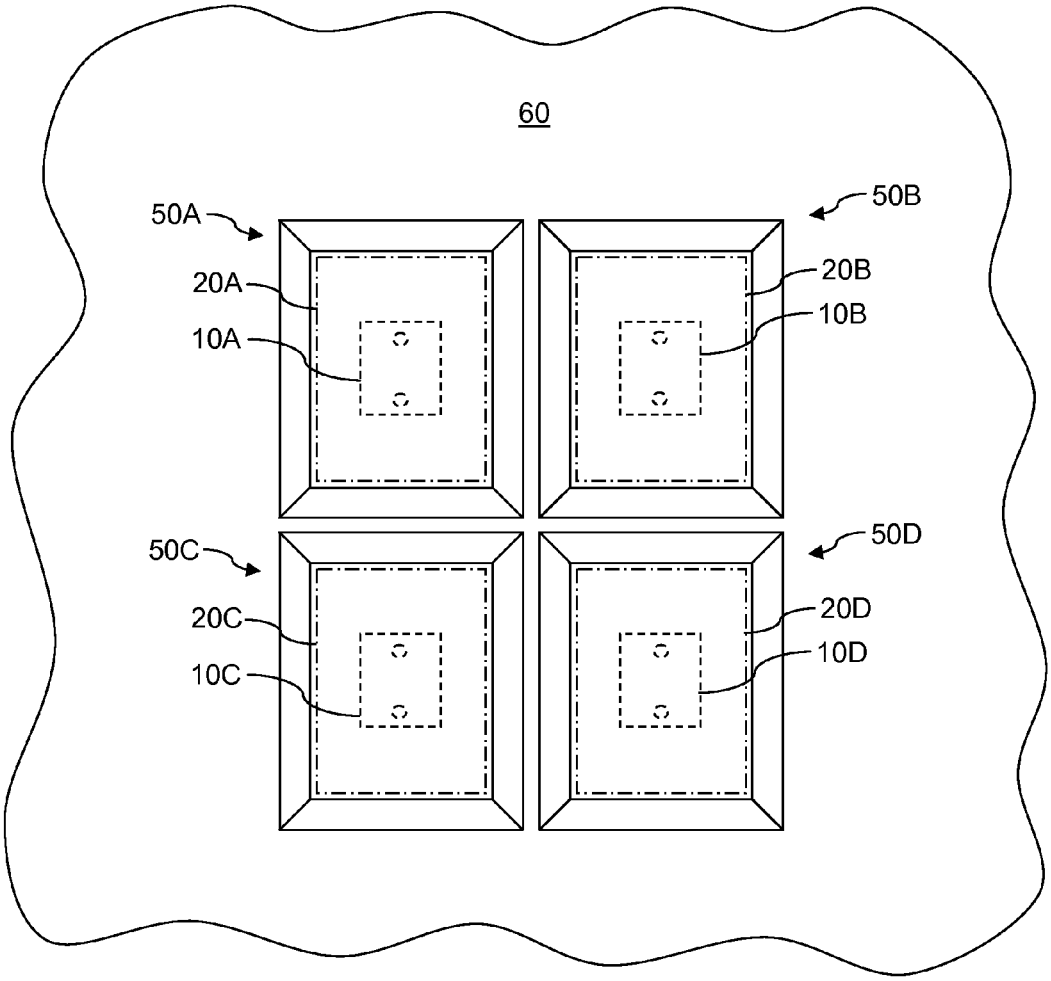
FIG. 11 is an illustration of a group of picture frames arranged in a first pattern using magnet-based mounting systems according to aspects of the present invention.

Referring specifically to FIG. 11, each frame plate 20A, 20B, 20C and 20D is generally centered with regard to its corresponding wall plate 10A, 10B, 10C and 10D, respectively. Assume that a user wants to space the four associated frames 50A, 50B, 50C and 50D farther apart from each other. With conventional picture frame mounting systems, the user must remove the mounting system for at least three of the frames 50, measure a new location, remount the hanging hardware, and mount the frames to the new positions.

Figure 12:
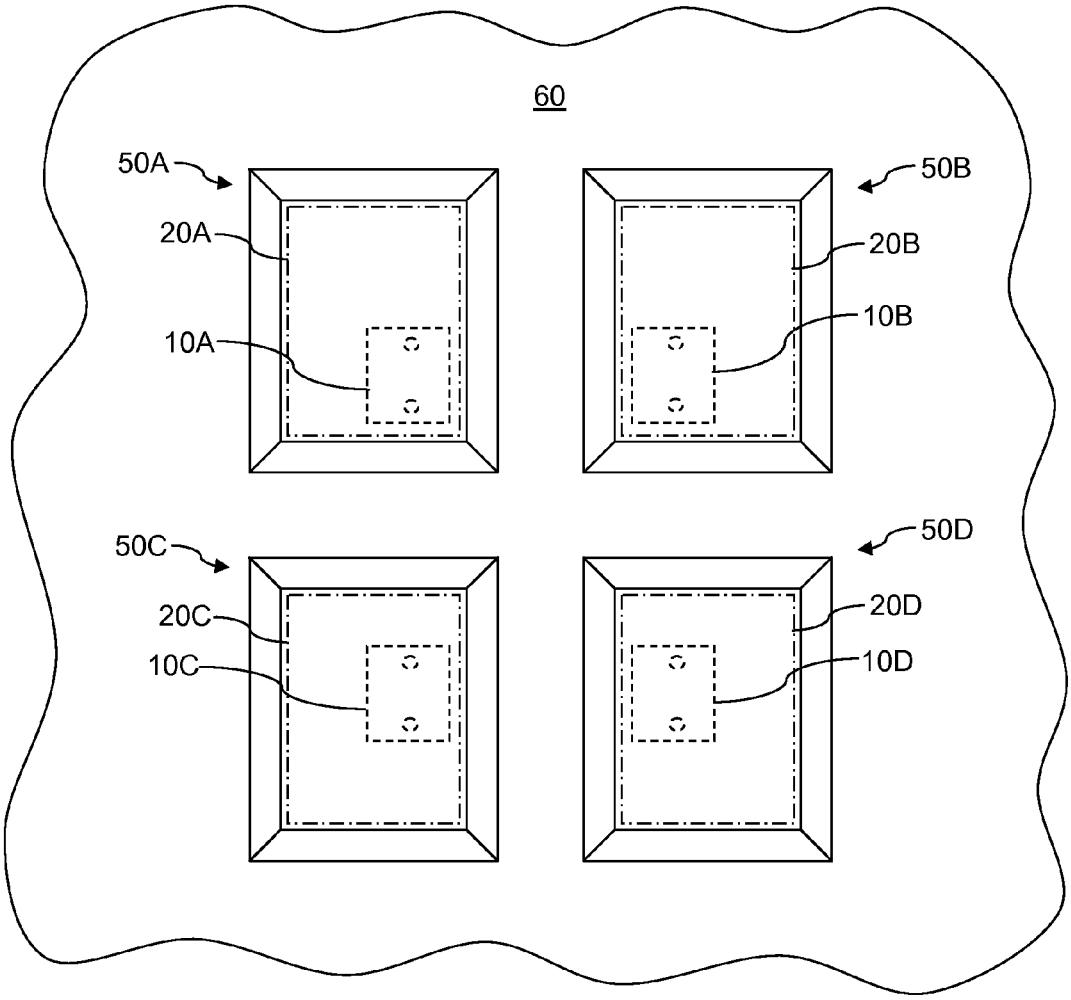
FIG. 12 is an illustration of the group of picture frames of FIG. 11, arranged in another pattern, without moving wall plates of the magnet-based mounting systems, according to aspects of the present invention.

However, referring to FIG. 12, a user can relocate any of the associated frames 50A, 50B, 50C and 50D without having to remove and relocate the associated wall plates 10A, 10B, 10C and 10D, respectively. Thus, the magnet-based frame mounting systems described more fully herein facilitate methods for repositioning and relocating mounted frames. The user merely slides or otherwise repositions one or more of the associated frames 50A, 50B, 50C and 50D, which correspondingly repositions their corresponding frame plates 20A, 20B, 20C and 20D, respectively. The wall plates 10A, 10B, 10C and 10D all remain in their original locations. Even if the frame plates 20A, 20B, 20C and 20D are not centered within their respective wall plates 10A, 10B, 10C and 10D, the magnetic coupling between them still holds the associated frames 50A, 50B, 50C and 50D to the wall 60 in a user-set position.

Figure 13:
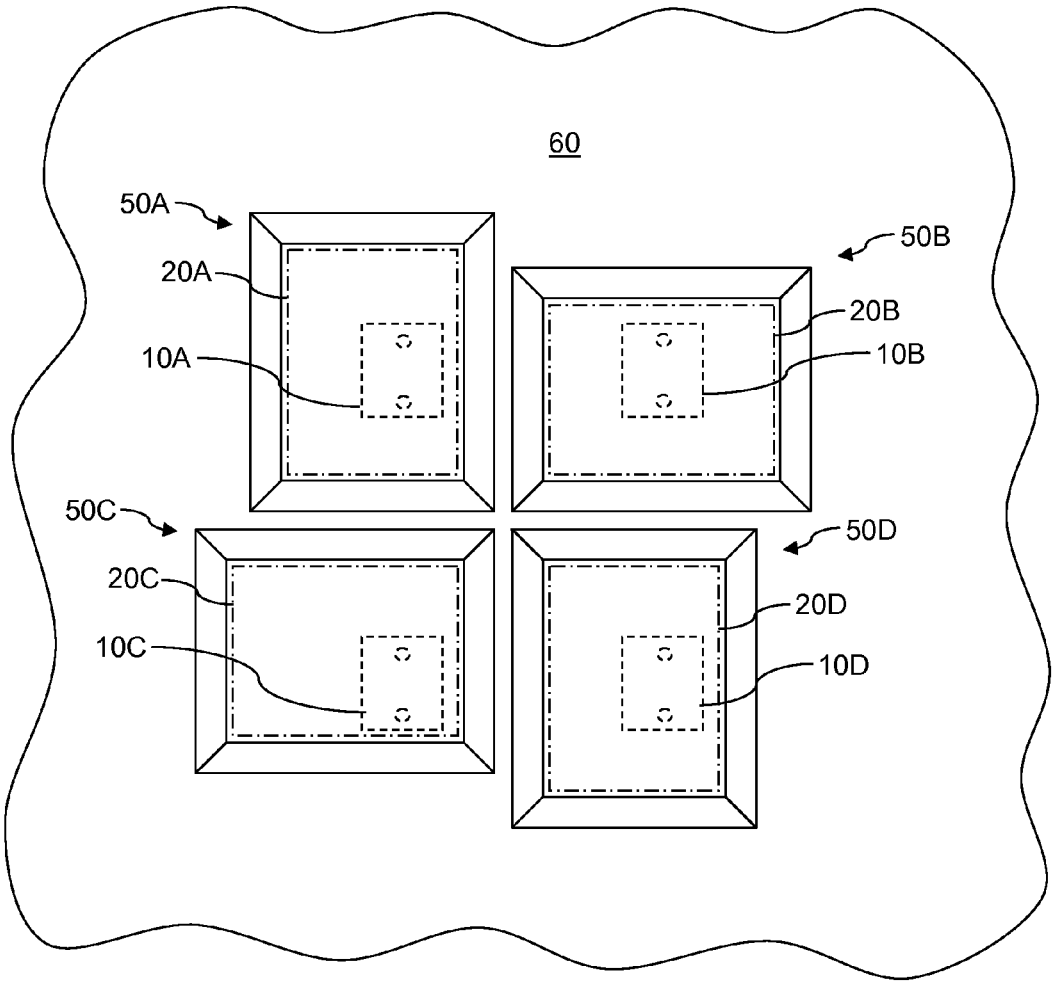
FIG. 13 is an illustration of the group of picture frames of FIG. 11, arranged in yet another pattern, without moving wall plates of the magnet-based mounting systems, according to aspects of the present invention.

FIG. 13 illustrates another illustrative pattern of coordinating the associated frames 50A, 50B, 50C and 50D into a desired pattern. Assume that the user desires the associated frames 50A, 50B, 50C and 50D to be at an angle similar to FIG. 13. The user merely has to reposition the associated frames 50A, 50B, 50C and 50D and rotate them parallel to their associated wall plate 10A, 10B, 10C and 10D, respectively. The wall plates 10A, 10B, 10C and 10D are unmoved and are in the same position as they were in FIGS. 11 and 12, yet the associated frames 50B and 50C have been rotated 90 degrees.

Figure 14:
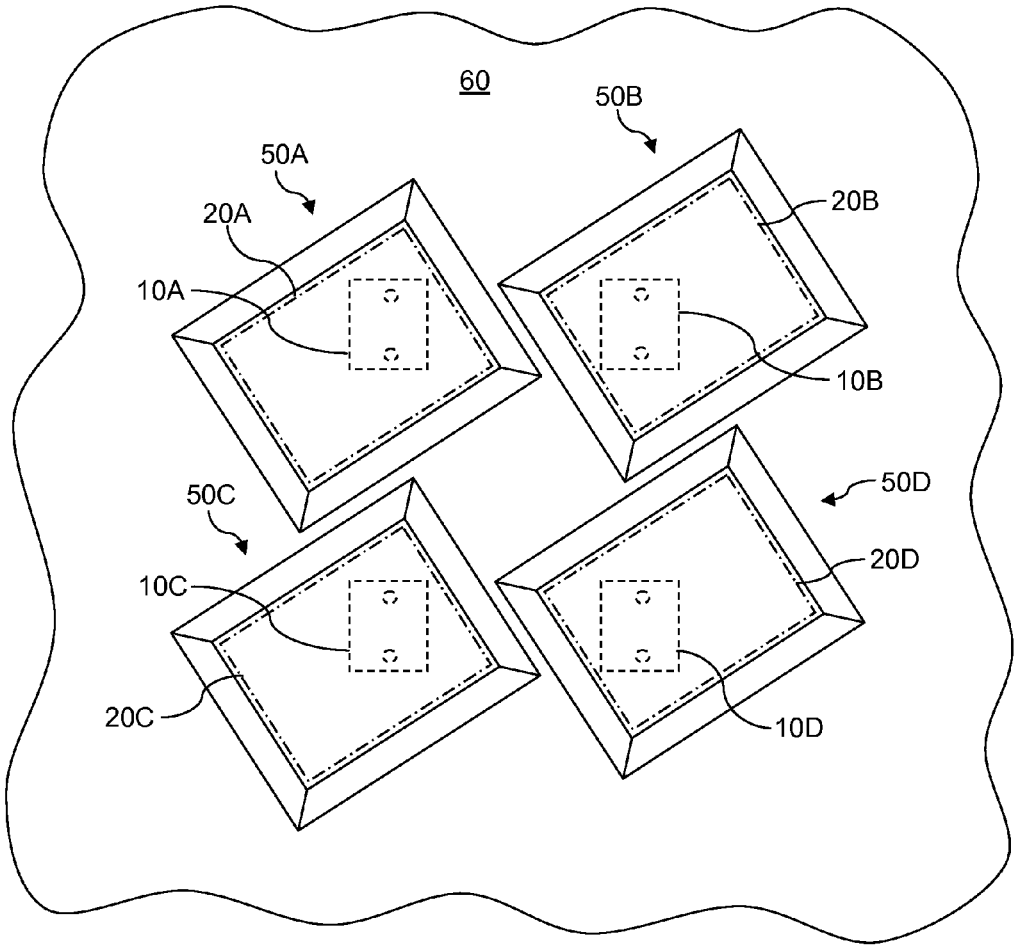
FIG. 14 is an illustration of the group of picture frames of FIG. 11, arranged in still another pattern, without moving wall plates of the magnet-based mounting systems, according to aspects of the present invention.

Still further, FIG. 14 illustrates a yet another exemplary pattern of coordinating the associated frames 50A, 50B, 50C and 50D. Assume the user desires a windmill pattern as depicted in FIG. 14. The user merely needs to reposition the associated frames 50A, 50B, 50C and 50D to the desired coordinated pattern. Again, the wall plates 10A, 10B, 10C and 10D, are in the same position as they were in FIGS. 11-13, yet the associated frames 50A, 50B, 50C and 50D are now in a completely different pattern, and are illustrated at an angle relative to a vertical plum line of the corresponding wall 60.

Thus, in each of the coordinated patterns represented in FIGS. 11-14, the wall plates 10A, 10B, 10C and 10D are all in the same position on the wall 60. However, in each of the FIGS. 11-14, the frames 50A, 50B, 50C and 50D are arranged in a different pattern, yet each frame 50A, 50B, 50C and 50D conceals its associated wall plates 10A, 10B, 10C and 10D, respectively and frame plate 20A, 20B, 20C and 20D, respectively.

In another example, a user may want to mount three frames 50 on a wall 60 coordinated in a line, where the top of each of the frames are in the same line and the frames 50 are equidistant from adjacent frames.

When measuring out where to mount each wall plate 10, the user does not have to be exact. The user merely needs to position each wall plate 10 "close" to the frame's desired position (within the range of adjustment provided by the magnetic interaction between the wall plate and corresponding frame plate). The range of adjustment depends at least in part, upon the relative sizes of the wall plate and corresponding frame plate. For instance, the frame plate may be dimensioned up to the size of the frame so that the frame conceals the frame plate. The wall plate will likely be smaller than the frame plate and corresponding frame to provide a range of adjustment of the frame such that the frame conceals the frame plate and wall plate.

Keeping with the above example, each frame 50 may be repositioned to create the line of frames where the top of each of the frames are in the same line and the frames 50 are equidistant from adjacent frames.

Figure 15:
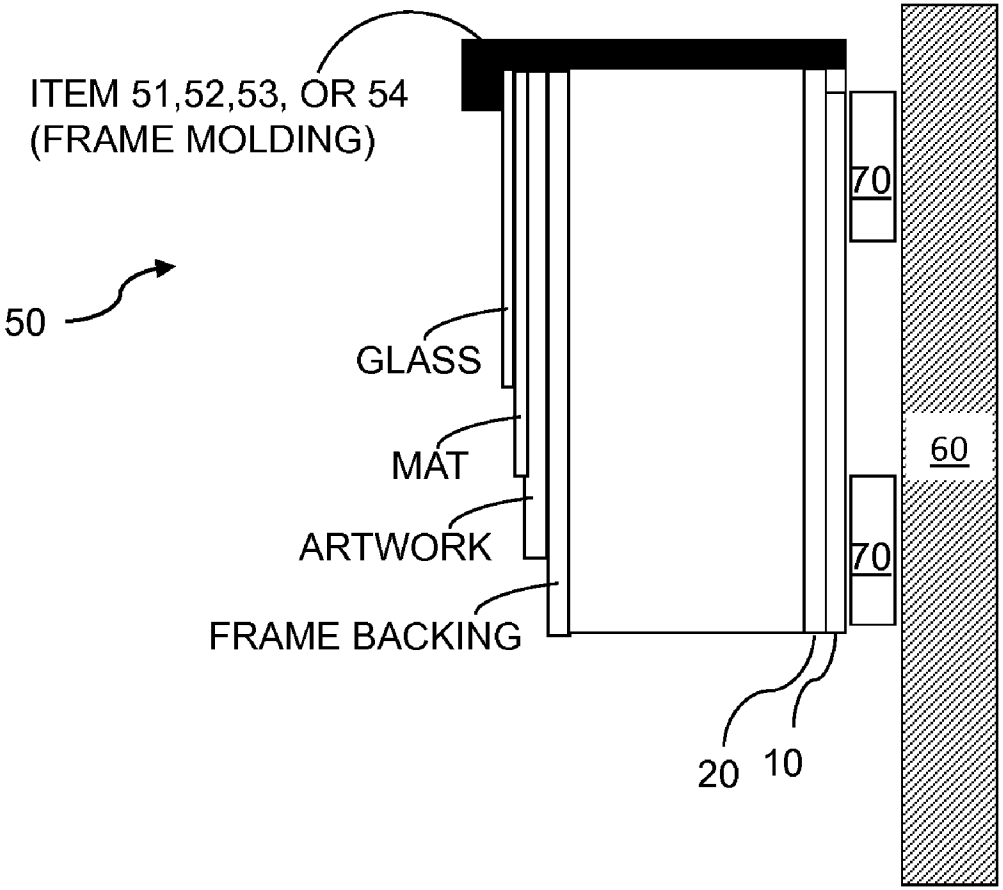
FIG. 15 is a schematic side view of the apparatus including a frame molding and optional spacers.

FIG. 15 is a schematic side view of a magnet-based frame mounting system according to still further aspects of the present invention. This figure illustrates that a frame 50 may comprise, for example, sides or frame moldings 51, 52, 53, 54, glass, a mat, art work, and a frame backing, e.g., Styrofoam, corrugated cardboard, or other core material that forms a back to which the frame plate 20 is mounted. Optional spacers 70 can be used to help achieve the desired distance between frame 50 and the wall 60, if desired. If spacers 70 are used, the spacers 70 can be mechanically mounted to the wall 60. The use of spacers 70 may be particularly helpful, e.g., where a more three dimensional aesthetic is desired. The spacers 70 may also be used as an alternative arrangement to the backer 64 described with reference to FIG. 4, e.g., in retrofitting existing frames to compensate for the depth of the frame molding profile.

A magnet-based frame mounting system can be used as both original equipment, by being manufactured into the frame to be hung, or as an aftermarket retrofit. In the case of original equipment product, magnets can form a grid and can be molded into the back of the device. In the case of the aftermarket device, the magnetic grid can be pre-molded into a sheet type material that can be cut to size to fit the back of the frame to be mounted. This cut to size grid may have an adhesive back to facilitate attachment to the frame, or other coupling arrangements may be utilized. A magnetically attractive plate that cooperates with the magnetic grid can have a grid pattern of holes to facilitate mounting to planar surface such as a wall, or other structures may be utilized, examples of which are set out in further detail herein.

To increase or decrease the magnetic holding force, e.g., where magnets are provided in a grid, magnets of different flux density or stiction properties can be used for the grid or the grid density can be altered. Regardless of magnet type, the size of the overall magnetic portion and corresponding magnetically attractive plate can be altered by size, and/or the magnetic properties of the magnet(s) can be selected, e.g., to accommodate frames and corresponding artwork of different sizes and weights. Also, the magnetically attractive plate(s) may be made from various magnetically attractive materials and/or may have different magnetic attraction properties.

Regardless of the configuration of the wall plate and frame plate (several examples set out in greater detail herein), the frame can be initially positioned with a macro/coarse range of precision. That is, once the wall plate is mounted to a wall in approximately the desired location of the frame, the user can set a "ballpark" position of the frame. The user can then make micro/fine adjustments to reset or otherwise relocate the frame to achieve a desired frame position by changing the position and/or orientation of the frame (within the ability of the wall plate and frame plate to retain magnetic attraction).

Once set, the frame will remain at its user set position, and the frame and associated mechanically attached items, conceal the wall plate and frame plate, e.g., potentially leaving only the frame and the mounting surface (artwork, mat, etc.) viewable from any perspective (front, top, bottom, sides). The magnetic bond between the magnet(s) and magnetically attractive plate(s) is the only means by which the frame assembly is held in place to the wall. The complementing nature of this magnetic arrangement allows for up to 360 degree adjustment of frame parallel to the wall plate, which is typically also parallel to the wall. The range of adjustment is limited only by the ability of the magnetic arrangement to maintain its magnetic bond between magnetically attractive plate(s) and magnet(s).

Various implementations of the magnet-based frame mounting system provide a relatively large contact area between the major planar surface of the wall plate and the frame plate. This distributes the weight of the frame and its contents across the entire surface area of contact of the magnet-based frame mounting system, thus eliminating or otherwise reducing the likelihood of frame distortion occurring due to imbalanced weight distribution of the mounted object.

Still further aspects of the present invention provide a magnet-based frame mounting system that maintains the use and esthetics of traditional frames by utilizing a frame itself to conceal the magnet-based frame mounting system used to mount the frame to a wall during use. In this regard, a frame mounted to a wall using the magnet-based frame mounting system can be easily removed from the wall, thus providing a semi-permanent mounting arrangement. Moreover, the magnet-based frame mounting system may be removed from the frame and/or wall with no more impact/damage than conventional hanging devices using wire and nails or screws.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Having thus described the invention of the present application in detail and by reference to embodiments thereof, it will be apparent that modifications and variations are possible without departing from the scope of the invention defined in the appended claims.

What is claimed is:

1. A magnet-based frame mounting system comprising:

a frame plate having a first surface that mounts to a recessed rear surface of a frame, wherein the frame plate is magnetically attractive; and a magnetically attractive wall plate including:

a top bend;

a bottom bend;

a major planar surface; and a first surface that mounts directly to a wall, such that when the wall plate is mounted to the corresponding wall, a gap forms between the major planar surface of the wall plate and the corresponding wall;

wherein:

when the frame plate is mounted to the frame, the wall plate is mounted to the corresponding wall, and the frame plate is positioned over the wall plate, the wall plate magnetically couples to the frame plate such that:

the frame plate is concealed by the frame;

the wall plate is concealed by the frame; and the frame is repositionable in any direction parallel to the wall plate without repositioning the wall plate such that the frame stays at a set location based upon the magnetic coupling between the frame plate and the wall plate.

2. The system of claim 1, wherein:

the frame plate has no permanently magnetic poles; and the wall plate comprises a permanent magnet.

3. The system of claim 1, further comprising:

an intermediate plate, wherein the intermediate plate is magnetically attractive and magnetically couples between the frame plate and the wall plate.

4. The system of claim 3, wherein:

the frame plate has no permanently magnetic poles;

the wall plate has no permanently magnetic poles; and the intermediate plate comprises a permanent magnet.

5. The system of claim 1, wherein:

the wall plate is a flexible material such that the wall plate deflects to couple with the frame plate when a depth of the formed air gap is less than a depth of the recessed surface of the frame.

6. A method for mounting a frame on a wall, the method comprising:

mounting a frame plate to a recessed rear surface of a frame, wherein the frame plate is magnetically attractive;

mounting a magnetically attractive wall plate including a top bend, a bottom bend, and a major planar surface directly to a wall such that a gap forms between the major planar surface of the wall plate and the corresponding wall;

magnetically coupling the frame plate to the wall plate such that the frame conceals the frame plate and the frame conceals the wall plate; and repositioning the frame in any direction parallel to the wall plate to achieve a desired location on the wall without moving the wall plate such that the frame stays at the desired location based upon the magnetic coupling between the frame plate and the wall plate.

7. The method of claim 6, wherein:

mounting a frame plate comprises mounting a frame plate having no permanently magnetic poles, within the rear surface of the frame; and mounting a wall plate comprises mounting a wall plate having a permanent magnet, directly to the wall.

8. The method of claim 6, further including allowing the wall plate to flex outward from the wall when the frame plate is magnetically coupled to the wall plate.

9. The method of claim 6, wherein magnetically coupling the frame plate to the wall plate further comprises:

placing an intermediate plate between the frame plate and the wall plate, wherein the intermediate plate is magnetically attractive.

10. The method of claim 9, wherein:

mounting a frame plate comprises mounting a frame plate having no permanent magnetic poles;

mounting a wall plate comprises mounting a wall plate having no permanent magnetic poles; and placing an intermediate plate between the frame plate and the wall plate comprises placing an intermediate plate having a permanent magnet between the frame plate and the wall plate.

11. The method of claim 6, wherein repositioning the frame in any direction comprises repositioning the frame so as to conceal the wall plate and the frame plate with the frame.

12. The method of claim 11, wherein magnetically coupling the frame plate to the wall plate further comprises placing an intermediate plate between the frame plate and the wall plate, wherein the intermediate plate is magnetically attractive.

13. A method of hanging multiple frames on a wall comprising:

mounting a first frame plate to a recessed rear surface of a first frame, wherein the first frame plate is magnetically attractive;

mounting a magnetically attractive first wall plate including a top bend, a bottom bend, and a major planar surface directly to a wall such that a gap forms between the major planar surface of the first wall plate and the corresponding wall;

magnetically coupling the first frame plate to the first wall plate;

repositioning the first frame in any direction parallel to the first wall plate to achieve a set location on the wall without moving the first wall plate such that the first frame stays at the desired location based upon the magnetic coupling between the first frame plate and the first wall plate;

mounting a second frame plate to a recessed rear surface of a second frame, wherein the second frame plate is magnetically attractive;

mounting a magnetically attractive second wall plate including a top bend, a bottom bend, and a major planar surface directly to a wall such that a gap forms between the major planar surface of the second wall plate and the corresponding wall and the second wall plate is distinct and spaced from the first wall plate;

magnetically coupling the second frame plate to the second wall plate; and repositioning the second frame in any direction parallel to the second wall plate without moving the second wall plate to achieve a set location of the second frame that forms a desired pattern in coordination with the set location of the first frame such that the second frame stays at the desired location based upon the magnetic coupling between the second frame plate and the second wall plate.

14. The method of claim 13, wherein magnetically coupling the first frame plate to the first wall plate further comprises placing a first intermediate plate between the first frame plate and the first wall plate, wherein the first intermediate plate is magnetically attractive.

15. The method of claim 14, wherein magnetically coupling the second frame plate to the second wall plate further comprises placing a second intermediate plate between the second frame plate and the second wall plate, wherein the second intermediate plate is magnetically attractive.

16. The method of claim 13, wherein:

repositioning the first frame in any direction further includes concealing the first frame plate and the first wall plate with the first frame; and repositioning the second frame in any direction further includes concealing the second frame plate and the second wall plate with the second frame.

17. The method of claim 13, wherein repositioning the second frame further comprises repositioning the second frame such that the top of the second frame is aligned with the top of the first frame.

18. The method of claim 17, further comprising:

magnetically coupling a plurality of additional frames to the wall, each additional one of the plurality of frames coupled to the wall by:

a frame plate within a rear surface of the associated one of the plurality of additional frames; and a corresponding individual wall plate mounted directly to the wall;

repositioning each frame in any direction parallel to the wall to locate the frames in a desired pattern such that:

the top of each frame is aligned with the top of adjacent frames;

each frame is equidistant from adjacent frames; and each frame stays at the positioned location based upon the magnetic coupling between the corresponding frame plate and the corresponding wall plate.

* * * * *